US006599865B1

(12) United States Patent
Esche, Jr. et al.

(10) Patent No.: US 6,599,865 B1
(45) Date of Patent: Jul. 29, 2003

(54) EFFECTIVE ANTIOXIDANT COMBINATION FOR OXIDATION AND DEPOSIT CONTROL IN CRANKCASE LUBRICANTS

(75) Inventors: Carl K. Esche, Jr., Richmond, VA (US); Vincent J. Gatto, Midlothian, VA (US); William Y. Lam, Glen Allen, VA (US)

(73) Assignee: Ethyl Corporation, Richmond, VA (US)

( * ) Notice: Subject to any disclaimer, the term of this patent is extended or adjusted under 35 U.S.C. 154(b) by 0 days.

(21) Appl. No.: 10/194,517

(22) Filed: Jul. 12, 2002

(51) Int. Cl.[7] ..... C10M 141/06
(52) U.S. Cl. ..... 508/254; 508/322; 508/331
(58) Field of Search ..... 508/254, 322, 508/331

(56) References Cited

U.S. PATENT DOCUMENTS

| | | | | | |
|---|---|---|---|---|---|
| 2,384,577 | A | | 9/1945 | Thomas | |
| 2,710,872 | A | | 6/1955 | Thompson | |
| 2,781,318 | A | | 2/1957 | Cyphers | |
| 2,786,866 | A | | 3/1957 | Hook et al. | |
| 2,897,152 | A | | 7/1959 | Elliott et al. | |
| 3,407,222 | A | | 10/1968 | Lies | |
| 3,536,706 | A | | 10/1970 | Randell | |
| 3,867,359 | A | | 2/1975 | Beadle | |
| 3,925,215 | A | * | 12/1975 | Jervis et al. | 508/254 |
| 4,072,619 | A | | 2/1978 | Williams et al. | |
| 4,090,970 | A | * | 5/1978 | Braid | 508/251 |
| 4,758,362 | A | | 7/1988 | Butke | |
| 4,876,375 | A | | 10/1989 | Lam | |
| 4,885,365 | A | | 12/1989 | Lam | |
| 4,927,552 | A | | 5/1990 | Lam | |
| 4,957,643 | A | | 9/1990 | Lam | |
| 5,073,278 | A | | 12/1991 | Schumacher et al. | |
| 5,157,118 | A | | 10/1992 | Salomon | |
| 5,167,844 | A | | 12/1992 | Schumacher et al. | |
| 5,200,100 | A | | 4/1993 | Kapuscinski et al. | |
| 5,319,081 | A | * | 6/1994 | Spivack | 544/38 |
| 5,503,759 | A | | 4/1996 | Evans et al. | |
| 5,560,848 | A | * | 10/1996 | Kim | 508/254 |
| 5,614,124 | A | | 3/1997 | Esche, Jr. et al. | |
| 5,686,397 | A | | 11/1997 | Baranski et al. | |
| 5,693,598 | A | | 12/1997 | Abraham et al. | |
| 5,731,273 | A | * | 3/1998 | Field | 508/251 |
| 5,789,357 | A | | 8/1998 | Baranski et al. | |
| 5,840,672 | A | | 11/1998 | Gatto | |
| 5,902,776 | A | | 5/1999 | Dohner et al. | |
| 6,174,842 | B1 | | 1/2001 | Gatto et al. | |
| 6,306,802 | B1 | * | 10/2001 | Shaub | 508/364 |
| 6,326,336 | B1 | | 12/2001 | Gatto et al. | |

* cited by examiner

*Primary Examiner*—Jacqueline V. Howard
(74) *Attorney, Agent, or Firm*—Dennis H. Rainear

(57) ABSTRACT

It has unexpectedly been found that the combination of (1) an alkylated diphenylamine, (2) a sulfurized olefin/fatty oil and/or an ashless dialkyldithiocarbamate, and (3) an alkylated phenothiazine, is highly effective at controlling crankcase lubricant oxidation and deposit formation. The present invention includes lubricating compositions, lubricating additives, and methods for improving the antioxidancy and/or deposit formation properties of a lubricating composition.

80 Claims, No Drawings

EFFECTIVE ANTIOXIDANT COMBINATION FOR OXIDATION AND DEPOSIT CONTROL IN CRANKCASE LUBRICANTS

TECHNICAL FIELD OF THE INVENTION

This invention relates to lubricating oil compositions, their method of preparation, and use. More specifically, this invention relates to lubricating oil compositions containing an alkylated diphenylamine, a sulfurized olefin/fatty oil and/or an ashless dialkyldithiocarbamate, and an alkylated phenothiazine. The lubricating oil compositions of this invention are particularly useful as crankcase lubricants.

BACKGROUND OF THE INVENTION

Lubricating oils as used in the internal combustion engines and transmissions of automobiles or trucks are subjected to a demanding environment during use. This environment results in the oil suffering oxidation which is catalyzed by the presence of impurities in the oil, such as iron compounds, and is also promoted by the elevated temperatures of the oil during use.

The oxidation of lubrication oils during use is usually controlled to some extent by the use of antioxidant additives which may extend the useful life of the lubricating oil, particularly by reducing or preventing unacceptable viscosity increases. Aminic antioxidants are antioxidants that contain one or more nitrogen atoms. An example of an aminic antioxidant is phenothiazine. The prior art discloses the many teachings on the synthesis and uses of phenothiazine. Phenothiazine antioxidants have been used as a stand alone additive, chemically modified or grafted onto the backbone of polymers.

A new trend in engine oils is a shift to lower and lower phosphorus levels. Thus, at some point the industry will require lubricant formulations for crankcase with significantly lower, zero or essentially zero phosphorus content.

Existing lubricants employing phenothiazine are taught in U.S. Pat. No. 5,614,124 and references cited therein, all of which are incorporated herein in their entirety by reference.

Existing lubricants employing alkylated diarylamine and a sulfurized compound are taught in U.S. Pat. Nos. 5,840,672, 6,174,842, 6,326,336, and references cited therein, all of which are incorporated herein in their entirety by reference.

U.S. Pat. No. 2,781,318 teaches the synthesis and use of dialkylphenothiazines as an oil soluble ashless detergent additive for mineral lubricating oils. The alkylation is on the aromatic ring and each alkyl group contains 4 to 16 carbons.

U.S. Pat. No. 3,536,706 teaches the use of branched mono-alkylated alkylphenothiazine as an antioxidant additive for synthetic lubricants. The alkyl groups contain 4 to 12 carbons.

U.S. Pat. No. 4,072,619 teaches the use of nitrogen substituted polyoxyalkylene phenothiazines for use in synthetic motor oils.

U.S. Pat. No. 5,073,278 teaches a lubricant composition containing an aromatic amine and a sterically hindered amine. The aromatic amine can be a ring-substituted alkylphenothiazine or nitrogen substituted alkylated phenothiazine.

U.S. Pat. No. 5,157,118 teaches the nitrogen substitution of a phenothiazine where the nitrogen substitutent contains an additional sulfur atom.

U.S. Pat. No. 5,200,100 teaches the grafting of a monomer onto the backbone of an E-P polymer. The monomer contains an aminoalkylphenothiazine moiety.

U.S. Pat. No. 5,503,759 teaches the alkylation of mixtures of diphenylamine, alkyldiphenylamines, phenothiazine and alkylphenothiazines with an olefin in the presence of an acid catalyst.

U.S. Pat. No. 5,167,844 teaches a lubricant formulation containing at lease three additives to guard against oxidative degradation. These three additives are: alkali metal dialkyl dithiophosphates, an aromatic amine such as an alkylphenothiazine and a compound from either a sterically hindered amine, acyclic sterically hindered amine or alkylphenols.

The aforementioned patents are hereby incorporated by reference.

SUMMARY OF THE INVENTION

In broadest terms, a lubricating composition of the present invention comprises a major amount of lubricating oil, and a minor amount of an oil soluble alkylated diarylamine, an oil soluble alkylated phenothiazine, and an oil soluble sulfurized compound. It is preferred that the sulfurized compound is selected from the group consisting of sulfurized olefins, and sulfurized fatty oils. A second lubricating composition of the present invention comprises a major amount of lubricating oil, and a minor amount of an oil soluble alkylated diarylamine, an oil soluble alkylated phenothiazine, and an oil soluble ashless dialkyldithiocarbamate.

While any conventional or non-conventional lubricating oil may be used in the present invention, it is preferred that the lubricating oil is selected from the group consisting of paraffinic oils, naphthenic oils, aromatic oils, and synthetic oils and mixtures thereof.

The concentration of the alkylated diarylamine may range from about 0.001 to 10 wt % in the lubricating composition, however, it is preferred that the concentration range from about 0.05 to 2.5 wt % in the lubricating composition.

It is preferred that the alkylated diarylamine is selected from the group consisting of: diphenylamine, alkylated diphenylamine, 3-hydroxydiphenylamine, N-phenyl-1,2-phenylenediamine, N-phenyl-1,4-phenylenediamine, monobutyldiphenylamine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyldiphenylamine, p-oriented styrenated diphenylamine, mixed butyloctyidiphenylamine, and mixed octylstryryldiphenylamine.

The concentration of the alkylated phenothiazine may range from about 0.001 to 10 wt % in the lubricating composition, however, it is preferred that the concentration range from about 0.05 to 2.5 wt % in the lubricating composition.

It is further preferred that the alkylated phenothiazine have the chemical formula:

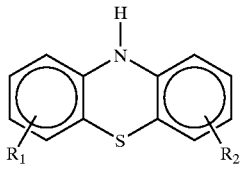

wherein R1 is a linear or branched C4–C24 alkyl, aryl, heteroalkyl or alkylaryl group and R2 is hydrogen or a linear or branched C4–C24 alkyl, aryl, heteroalkyl, or alkylaryl group.

It is even more preferred that the alkylated phenothiazine is selected from the group consisting of monotetradecylphenothiazine, ditetradecylphenothiazine, monodecylphenothiazine, didecylphenothiazine, monononylphenothiazine, dinonylphenothiazine, monoctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

While the sulfurized compound may be present in sufficient concentration so as to provide from about 25 to 5000 ppm of sulfur in the lubricating composition, it is preferred that the sulfurized compound be present in a concentration sufficient to provide from about 150 to 2500 ppm of sulfur in the lubricating composition.

It is preferred that the sulfurized olefin is selected from the group consisting of sulfurized C4–C24 alpha-olefins, sulfurized isomerized C4–C24 alpha-olefins, sulfurized branched C4–C24 olefins, sulfurized cyclic C4–C24 olefins, HITEC® 7084, HITEC® 7188, HITEC® 312, ADDITIN RC 2540-A, and combinations thereof. HiTEC® is a registered trademark of Ethyl Corporation.

It is preferred that the sulfurized fatty oil is selected from the group consisting of sulfurized corn oil, sulfurized canola oil, sulfurized cottonseed oil, sulfurized grapeseed oil, sulfurized olive oil, sulfurized palm oil, sulfurized peanut oil, sulfurized coconut oil, sulfurized rapeseed oil, sulfurized sesame seed oil, sulfurized soybean oil, sulfurized sunflower seed oil, sulfurized tallow, sulfurized fish oil including herring oil and sardine oil, ADDITIN R 4410, ADDITIN R 4412-F, ADDITIN R 4417, ADDITIN RC 2515, ADDITIN RC 2526, ADDITIN RC 2810-A, ADDITIN RC 2814-A, ADDITIN RC 2818-A, and combinations thereof. ADDITIN® is a registered trademark of Rhein Chemie Corporation.

It is preferred that the ashless dialkyldithiocarbamate have a concentration sufficient to provide from about 150 to 2500 ppm of sulfur in the lubricating composition. It is further preferred that the ashless dialkyldithiocarbamate is selected from the group consisting of: methylenebis (dialkyldithiocarbamate), ethylenebis (dialkyldithiocarbamate), isobutyl disulfide-2,2'-bis (dialkyld ithiocarbamate), dibutyl-N,N-dibutyl-(d ithiocarbamyl)succinate, 2-hydroxypropyl dibutyidithiocarbamate, butyl(dibutyid ithiocarbamyl) acetate, S-carbomethoxy-ethyl-N,N-dibutyl dithiocarbamate, hydroxyalkyl substituted dialkyldithiocarbamates, dithiocarbamates prepared from unsaturated compounds, dithiocarbamates prepared from norbornylene, and dithiocarbamates prepared from epoxides, and mixtures and precursors thereof.

Additionally, the lubricating composition of the present invention may comprise at least one additional component selected from the group consisting of: dispersants, detergents, anti-wear additives, antioxidants, friction modifiers, anti-foaming additives, pour point depressants, and viscosity index improvers.

Irrespective of composition, it is preferred that the lubricating composition have a low phosphorus content or be substantially devoid of phosphorus. By "have a low phosphorus content" herein is meant a level between 250 ppm and 900 ppm phosphorus. By"substantially devoid of phosphorus" herein is meant a level of less than about 250 ppm. It is most preferred that the lubricating composition comprises zero phosphorus.

The lubricating composition of the present invention may also comprise two sulfurized compounds where one represents sulfurized olefins and/or sulfurized fatty oils, and the other represents ashless dialkyldithiocarbamates as defined above.

A lubricating additive of the present invention comprises an oil soluble alkylated diarylamine, an oil soluble alkylated phenothiazine, and an oil soluble sulfurized compound. The sulfurized compound is preferably selected from the group consisting of sulfurized olefins and sulfurized fatty oils. The lubricating additive forms a lubricating composition when added to a lubricating oil.

A second lubricating additive of the present invention comprises an oil soluble alkylated diarylamine, an oil soluble alkylated phenothiazine, and an ashless dialkyldithiocarbamate. The lubricating additive forms a lubricating composition when added to a lubricating oil.

The lubricating additive may also comprise two sulfurized compounds where one represents sulfurized olefins and/or sulfurized fatty oils, and the other represents ashless dialkyldithiocarbamates as defined above.

A method for improving the antioxidancy and/or deposit formation properties of a lubricating composition of the present invention comprises the step of including in the lubricating composition an oil soluble alkylated diarylamine, an oil soluble alkylated phenothiazine, and an oil soluble sulfurized compound. The sulfurized compound is preferably selected from the group consisting of sulfurized olefins and sulfurized fatty oils.

A second method for improving the antioxidancy and/or deposit formation properties of a lubricating composition of the present invention comprises the step of including in the lubricating composition an oil soluble alkylated diarylamine, an oil soluble alkylated phenothiazine, and an oil soluble ashless dialkyldithiocarbamate.

While the sulfurized compound used in the methods of the present invention may be present in sufficient concentration so as to provide from about 25 to 5000 ppm of sulfur in the lubricating composition, it is preferred that the sulfurized compound be present in a concentration sufficient to provide from about 150 to 2500 ppm of sulfur in the lubricating composition.

It is preferred that the sulfurized olefin used in the methods of the present invention is selected from the group consisting of sulfurized C4–C24 alpha-olefins, sulfurized isomerized C4–C24 alpha-olefins, sulfurized branched C4–C24 olefins, sulfurized cyclic C4–C24 olefins, HITEC® 7084, HITEC® 7188, HITEC® 312, ADDITIN RC 2540-A, and combinations thereof.

It is preferred that the sulfurized fatty oil used in the methods of the present invention is selected from the group consisting of sulfurized corn oil, sulfurized canola oil, sulfurized cottonseed oil, sulfurized grapeseed oil, sulfurized olive oil, sulfurized palm oil, sulfurized peanut oil, sulfurized coconut oil, sulfurized rapeseed oil, sulfurized sesame seed oil, sulfurized soybean oil, sulfurized sunflower seed oil, sulfurized tallow, sulfurized fish oil including herring oil and sardine oil, ADDITIN R 4410, ADDITIN R 4412-F, ADDITIN R 4417, ADDITIN RC 2515, ADDITIN RC 2526, ADDITIN RC 2810-A, ADDITIN RC 2814-A, ADDITIN RC 2818-A, and combinations thereof.

The concentration of the alkylated diarylamine used in the methods of the present invention may range from about 0.001 to 10 wt % in the lubricating composition, however, it is preferred that the concentration range from about 0.05 to 2.5 wt % in the lubricating composition.

It is preferred that the alkylated diarylamine used in the methods of the present invention is selected from the group consisting of: diphenylamine, alkylated diphenylamine, 3-hydroxydiphenylamine, N-phenyl-1,2-phenylenediamine, N-phenyl-1,4-phenylenediamine, monobutyldiphenylamine, dibutyidiphenylamine, monooctyldiphenylamine, dioctyidiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyldiphenylamine, p-oriented styrenated diphenylamine, mixed butyloctyldiphenylamine, and mixed octylstryryldiphenylamine.

The concentration of the alkylated phenothiazine used in the methods of the present invention may range from about 0.001 to 10 wt % in the lubricating composition, however, it is preferred that the concentration range from about 0.05 to 2.5 wt % in the lubricating composition.

It is further preferred that the alkylated phenothiazine have the chemical formula:

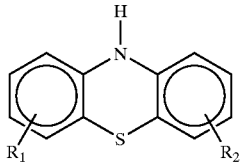

wherein R1 is a linear or branched C4–C24 alkyl, aryl, heteroalkyl or alkylaryl group and R2 is hydrogen or a linear or branched C4–C24 alkyl, heteroalkyl, or alkylaryl group.

It is even more preferred that the alkylated phenothiazine is selected from the group consisting of monotetradecylphenothiazine, ditetradecylphenothiazine, monodecylphenothiazine, didecylphenothiazine, monononylphenothiazine, dinonylphenothiazine, monoctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

While the ashless dialkyldithiocarbamate used in the methods of the present invention may be present in sufficient concentration so as to provide from about 25 to 5000 ppm of sulfur in the lubricating composition, it is preferred that the ashless dialkyldithiocarbamate be present in a concentration sufficient to provide from about 150 to 2500 ppm of sulfur in the lubricating composition.

It is preferred that the ashless dialkyldithiocarbamate used in the methods of the present invention is selected from the group consisting of: methylenebis(dialkyldithiocarbamate), ethylenebis(dialkyldithiocarbamate), isobutyl disulfide-2,2'-bis(dialkyldithiocarbamate), dibutyl-N,N-dibutyl-(dithiocarbamyl)succinate, 2-hydroxypropyl dibutyidithiocarbamate, butyl(dibutyldithiocarbamyl) acetate, S-carbomethoxy-ethyl-N,N-dibutyl dithiocarbamate, hydroxyalkyl substituted dialkyldithiocarbamates, dithiocarbamates prepared from unsaturated compounds, dithiocarbamates prepared from norbornylene, and dithocarbamates prepared from epoxides.

The methods of the present invention may also comprise the step of including two sulfurized compounds where one represents sulfurized olefins and/or sulfurized fatty oils, and the other represents ashless dialkyldithiocarbamates as defined above.

The methods may additionally comprise the step of including at least one additional component in said lubricating composition. It is preferred that at least one additional component is selected from the group consisting of: dispersants, detergents, anti-wear additives, antioxidants, friction modifiers, anti-foaming additives, pour point depressants, and viscosity index improvers.

DETAILED DESCRIPTION OF THE PREFERRED EMBODIMENT(S)

In accordance with the foregoing summary, the following presents a detailed description of the preferred embodiment of the invention that are currently considered to be the best mode.

We shall begin with a discussion of the components used in the present invention and conclude with a discussion of prepared additized test oils and their comparative results.

Alkylated Diarylamines

The diarylamines useful in this invention are well known antioxidants and there is no particular restriction on the type of diarylamine that can be used. Preferably, the diarylamine has the formula:

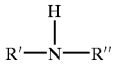

Wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups. The aryl is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

The diarylamines used in this invention can be of a structure other than that shown in the above formula that shows but one nitrogen atom in the molecule. Thus the diarylamine can be of a different structure provided that at least one nitrogen has 2 aryl groups attached thereto, e.g. as in the case of various diamines having a secondary nitrogen atom as well as two aryls on one of the nitrogens.

The diarylamines used in this invention should be soluble in the formulated crankcase oil package. Examples of some diarylamines that may be used in this invention include: diphenylamine; various alkylated diphenylamines; 3-hydroxydiphenylamine; N-phenyl-1,2-phenylenediamine; N-phenyl-1,4-phenylenediamine; monobutyldiphenylamine; dibutyldiphenylamine; monooctyldiphenylamine; dioctyldiphenylamine; monononyidiphenylamine; dinonyldiphenylamine; monotetradecyldiphenylamine; ditetradecyldiphenylamine, phenyl-alpha-naphthylamine;

monooctyl phenyl-alpha-naphthylamine; phenyl-beta-naphthylamine; monoheptyldiphenylamine; diheptyldiphenylamine; p-oriented styrenated diphenylamine; mixed butyloctyldiphenylamine; and mixed octylstryryldiphenylamine.

Examples of commercial diarylamines include, for example, IRGANOX L06, IRGANOX L57 and IRGANOX L67 from Ciba Specialty Chemicals; NAUGALUBE AMS, NAUGALUBE 438, NAUGALUBE 438R, NAUGALUBE 438L, NAUGALUBE 500, NAUGALUBE 640, NAUGALUBE 680, and NAUGARD PANA from Crompton Corporation; GOODRITE 3123, GOODRITE 3190X36, GOODRITE 3127, GOODRITE 3128, GOODRITE 3185X1, GOODRITE 3190X29, GOODRITE 3190X40, GOODRITE 3191 and GOODRITE 3192 from BF Goodrich Specialty Chemicals; VANLUBE DND, VANLUBE NA, VANLUBE PNA, VANLUBE SL, VANLUBE SLHP, VANLUBE SS, VANLUBE 81, VANLUBE 848, and VANLUBE 849 from R. T. Vanderbilt Company Inc.

Alkylated Phenothiazine

An alkylated phenothiazine suitable for this invention must be oil soluble and correspond to the general formula wherein $R_1$ is a linear or branched C4–C24 alkyl, aryl, heteroalkyl or alkylaryl group and $R_2$ is H or a linear or branched C4–C24 alkyl, aryl, heteroalkyl or alkylaryl group.

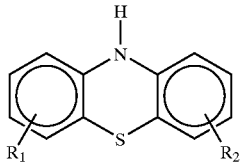

Typical examples of alkylphenothiazine are monotetradecylphenothiazine, ditetradecylphenothiazine, monodecylphenothiazine, didecylphenothiazine. monononylphenothiazine, dinonylphenothiazine, monoctylphenothiazine and dioctylphenothiazine.

General Preparation of an Alkylphenothiazine

Non-limiting examples of the preparation of alkylphenothiazine are mentioned in U.S. Pat. Nos. 5,614,124 and 2,781,318, each incorporated herein by reference.

EXAMPLE-1

C14 Alkylphenothiazine Synthesis

Into a round bottom flask equipped with a stirrer, reflux condenser, thermometer, thermocouple and nitrogen gas inlet tube are added the following: C14 alkyldiphenylamine ( 374 gms, 0.680 mols), elemental sulfur ( 65 gms, 2.04 mols), iodine ( 5.7 gms, 0.022 mols) and xylenes ( 344 ml). Nitrogen gas was bubbled into the reaction mixture at 200 ml/min and with vigorous agitation the reaction mixture was cooked at 140 C for 4 hours. The product was stripped of solvent and iodine to yield 396 gms of product. Found analytical data: %N=2.9%, %S=7.89% and 100 C KV=31.43.

EXAMPLE-2

Mixed Mono and Di-C9 Alkylphenothiazine Synthesis 50% Active—N438L

Into a round bottom flask equipped with a stirrer, reflux condenser, thermometer, thermocouple and nitrogen gas inlet tube are added the following: C9 alkyldiphenylamine (264.9 gms, 0.680 mols), elemental sulfur (65 gms, 2.04 mols), iodine (5.7 gms, 0.022 mols), base oil (286.7 gms) and xylenes (344 ml). Nitrogen gas was bubbled into the reaction mixture at 200 ml/min and with vigorous agitation the reaction mixture was cooked at 140 C for 4 hours. The product was stripped of solvent and iodine to yield 533 gms of product. Found analytical data: %N=1.56, %S=5.45 and 100 C KV=30.0.

Sulfurized Compounds: Olefins and/or Fatty Oils

The sulfurized olefins useful in this invention can be prepared by a number of known methods. They are characterized by the type of olefin used in their production and the final sulfur content. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Suitable alpha-olefins include any C4–C25 alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is the branched olefin counterpart of the alpha-olefin 1-butene.

Sulfur sources that may be used in the sulfurization reaction include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used in this invention. Examples of oils or fats that may be used include corn oil, canola oil, cottonseed oil, grapeseed oil, olive oil, palm oil, peanut oil, coconut oil, rapeseed oil, safflower seed oil, sesame seed oil, soyabean oil, sunflower seed oil, tallow, and combinations of these.

Examples of commercial sulfurized olefins which may be used in the present invention include HITEC® 7084 which contains approximately 20 weight % sulfur content, HITEC® 7188 which contains approximately 12 weight % sulfur content, HITEC® 312 which contains approximately 47.5 weight % sulfur content, all from Ethyl Corporation, and ADDITIN RC 2540-A which contains approximately 38 weight % sulfur content, from Rhein Chemie Corporation.

Examples of sulfurized fatty oils which may be used in the present invention include ADDITIN R 4410 which contains approximately 9.5 weight % sulfur content, ADDITIN R 4412-F which contains approximately 12.5 weight % sulfur content, ADDITIN R 4417 which contains approximately 17.5 weight % sulfur content, ADDITIN RC 2515 which contains approximately 15 weight % sulfur content, ADDITIN RC 2526 which contains approximately 26 weight % sulfur content, ADDITIN RC 2810-A which contains approximately 10 weight % sulfur content, ADDITIN RC 2814-A which contains approximately 14 weight % sulfur content, and ADDITIN RC 2818-A which contains approximately 16 weight % sulfur content, all from Rhein Chemie Corporation. It is preferred that the sulfurized olefin and/or sulfurized fatty oil be a liquid of low corrosivity and low active sulfur content as determined by ASTM D 1662.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 weight % sulfur, when added to the finished lubricant at a 1.0 weight % treat level, will deliver 2000 ppm of sulfur to the finished lubricant. A sulfurized fatty oil or olefin containing 10 weight % sulfur, when added to the finished lubricant at a 1.0 weight % treat level, will deliver 1000 ppm sulfur to the finished lubricant. It is preferred to add the sulfurized olefin or sulfurized fatty oil to deliver between 200 ppm and 2000 ppm sulfur to the finished lubricant.

Ashless Dialkyldithiocarbamates

The ashless dialkyldithiocarbamates suitable for use in the present invention are preferably soluble or dispersable in the crankcase oil package. It is also preferred that the ashless dialkyldithiocarbamate be of low volatility, preferably having a molecular weight greater than 250 daltons, most preferably having a molecular weight greater than 400 daltons. Examples of ashless dithiocarbamates that may be used include, but are not limited to, methylenebis (dialkyldithiocarbamate), ethylenebis (dialkyldithiocarbamate), isobutyl disulfide-2,2'-bis (dialkyldithiocarbamate), hydroxyalkyl substituted dialkyldithiocarbamates, dithiocarbamates prepared from unsaturated compounds, dithiocarbamates prepared from norbornylene, and dithiocarbamates prepared from epoxides, where the alkyl groups of the dialkyldithiocarbamate can preferably have from 1 to 16 carbons.

Examples of dialkyldithiocarbamates that may be used in this invention are disclosed in the following patents: U.S. Pat. No. 5,693,598; U.S. Pat. No. 4,876,375; U.S. Pat. No. 4,927,552; U.S. Pat. No. 4,957,643; U.S. Pat. No. 4,885,365; U.S. Pat. No. 5,789,357; U.S. Pat. No. 5,686,397; U.S. Pat. No. 5,902,776; U.S. Pat. No. 2,786,866; U.S. Pat. No. 2,710,872; U.S. Pat. No. 2,384,577; U.S. Pat. No. 2,897,152; U.S. Pat. No. 3,407,222; U.S. Pat. No. 3,867,359; and U.S. Pat. No. 4,758,362. Each of the aforementioned patents is hereby incorporated by reference.

Examples of preferred ashless dithiocarbamates are: Methylenebis(dibutyldithiocarbamate), Ethylenebis (dibutyldithiocarbamate), Isobutyl disulfide-2,2'-bis (dibutyldithiocarbamate), Dibutyl-N,N-dibutyl-(dithiocarbamyl)succinate, 2-Hydroxypropyl dibutyidithiocarbamate, Butyl(dibutyldithiocarbamyl) acetate, and S-carbomethoxy-ethyl-N,N-dibutyl dithiocarbamate. The most preferred ashless dithiocarbamate is methylenebis(dibutyldithiocarbamate).

Preparation of Additized Test Oils

A series of passenger car engine oils were blended as described in the attached Table 1. The preblend used was a 5W-30 passenger car engine oil formulated in Group II basestock containing 500 ppm of phosphorus derived from ZDDP, detergents, dispersants, pour point depressants and viscosity index improvers but no supplemental ashless antioxidants. The alkylated diphenylamine used was HITEC® 4793, a styryl octyl alkylated diphenylamine available from Ethyl Corporation. The tetradecyl diphenylamine used was obtained from the R. T. Vanderbilt Company. Sulfur compound S-1 was HITEC® 7084, a sulfurized olefin available from Ethyl Corporation containing approximately 20 wt. % sulfur. Sulfur compound S-2 was HITEC® 7188, a sulfurized olefin available from Ethyl Corporation containing approximately 12.5 wt. % sulfur. Sulfur compound S-3 was HITEC® 015, an ashless dialkyldithiocarbamate available from Ethyl Corporation containing approximately 30 wt. % sulfur. The tetradecylphenothiazine used was an experimental product prepared from the tetradecyl diphenylamine and contained approximately 8.1 wt. % sulfur and 2.7 wt. % nitrogen. The process oil used was a 100N paraffinic process oil. The components were blended into the preblend at 50° C. for approximately 3 hours and cooled.

Evaluation of Additized Test Oils for Deposit Control Evaluation of Passenger Car Engine Oils in the Micro-Oxidation Test The Micro-Oxidation Test is a commonly used technique for evaluating the deposit forming tendencies of a wide variety of passenger car and diesel lubricants as well as mineral and synthetic basestocks. The test measures the oxidative stability and deposit forming tendencies of lubricants under high temperature thin-film oxidation conditions. The ability to easily vary test conditions and the flexibility of presenting test results makes it a valuable research tool for screening a wide variety of lubricant products.

In this test, a thin-film of finished oil is accurately weighed onto an indented low carbon steel sample holder sitting in a glass impinger tube. The sample, coupon and impinger tube assembly is then immersed in a high temperature bath. Dry air is passed, at a specific rate, through the impinger tube, over the oil sample, and out of the impinger tube to the atmosphere. At specific time intervals the carbon steel sample holders are removed from the high temperature bath, rinsed with solvent to remove any remaining oil, and oven dried. The solvent washes are filtered to collect any deposits that dislodge from the carbon steel holders. The sample holders and collected deposits are weighed to determine the amount of deposit formed at the sampling interval. Results are reported as the percent of oil forming deposit at a specific time interval. The induction time to deposit formation can also be determined by calculating the intercept between the baseline formed where minimal deposits are seen, and the slope formed where a rapid rise in deposit formation is seen. Longer induction times correspond to improved deposit control. Another parameter of value in this test is the Performance Index (PI). The performance index represents the reduction in deposit formation of the additized finished oil over the entire sampling range of testing versus the baseline finished oil over the same sampling range. The formula for calculating PI is as follows: PI=[((area of baseline oil/area of additized oil)−1)×100]. A larger Performance Index (PI) corresponds to improved deposit control.

The test conditions used to evaluated the additized test oils were as follows: gas=dry air, flow=20 cc/minute, temperature=230° C., sampling interval=50, 60, 70, 80, 90, 100, 110, 120 minutes, sample size=approximately 20 $\mu$L accurately weighed.

The deposit control results are shown in the attached Table 1. The results show consistently that with all sulfur additive types, the combination of sulfur additive and alkylated phenothiazine (Oils 4, 5, and 6) are effective at improving deposit control (PI). Oils containing only sulfur additive (Oils 7, 8, and 9), or only alkylated phenothiazine (Oil 2), or only tetradecyldiphenylamine (Oil 3), are less effective at controlling deposits (PI). The oil containing sulfur additive and tetradecyldiphenylamine (Oil 10) is also less effective at controlling deposits (PI), indicating that the tetradecylphenothiazine/sulfurized additive combination is unique for controlling deposits.

Evaluation of Passenger Car Engine Oils in the Thermo-Oxidation Engine Oil Simulation Test (TEOST MHT-4)

The TEOST MHT-4 is a standard lubricant industry test for the evaluation of the oxidation and carbonaceous deposit-forming characteristics of engine oils. The test is designed to simulate high temperature deposit formation in the piston ring belt area of modern engines. The test utilizes a patented instrument (U.S. Pat. No. 5,401,661 and U.S. Pat. No. 5,287,731; the substance of each patent is hereby incorporated by reference) with the MHT-4 protocol being a relatively new modification to the test. Details of the test operation and specific MHT-4 conditions have been published by Selby and Florkowski in a paper entitled, "The Development of the TEOST Protocol MHT as a Bench Test of Engine Oil Piston Deposit Tendency" presented at the $12^{th}$ International Colloquium Technische Akademie Esslingen, January 11–13, 2000, Wilfried J. Bartz editor.

Oils #2 through #10 were evaluated in the TEOST MHT-4 with the results shown in the attached Table 1. Note that oils containing tetradecylphenothiazine and sulfur compound (Oils #4, 5, and 6) showed improved deposit control versus the corresponding sulfur compound alone (Oils #7, 8, and 9), tetradecylphenothiazine alone (Oil #2), tetradecyldiphenylamine alone (Oil #3), and a combination of tetradecyldiphenylamine and S-1 (Oil #10).

Evaluation of Additized Teat Oils for Oxidation Control Evaluation of Passenger Car Engine Oils in the Hot Oil Oxidation Test Oils #1 through #10 were evaluated for oxidative stability in the Hot Oil Oxidation Test. In this test 25.0 grams of the test oil is treated with an iron(III)naphthenate catalyst to deliver 250 ppm oil soluble iron to the test oil. The test oil is oxidized in a test tube by bubbling dry air through the oil at a specific rate (10 L/hour) and temperature (160° C.) and for a specific time period. At various time intervals (24, 32, 48, 56, 72, 80 hours) the oxidized oil is removed from the test apparatus and analyzed for viscosity at 40° C. The percent viscosity increase (PVI) of the oxidized oil (Ox) versus the fresh oil without catalyst (Fresh) is determined using the following formula: PVI @40° C.=((40° C. viscosity Ox−40° C. viscosity Fresh)/40° C. viscosity Fresh )×100.

An increase in PVI corresponds to an increase in the rate of oil oxidation. The Hot Oil Oxidation Test results are shown in Table 1. Note that the combination of alkylated phenothiazine and sulfur compound S-2 in Oil #5 affords excellent oxidation control versus the oil with only alkylated phenothiazine (#2), or the oil with only sulfur compound S-2 (#8) or the oil with only tetradecyldiphenylamine (#3).

While the invention has been described in connection with what is presently considered to be the most practical and preferred embodiments, it is to be understood that the invention is not to be limited to the disclosed embodiment (s), but on the contrary, is intended to cover various modifications and equivalent arrangements included within the spirit and scope of the appended claims, which are incorporated herein by reference.

What is claimed is:

1. A lubricating composition comprising a major amount of lubricating oil, and a minor amount of an oil soluble alkylated diarylamine, an oil soluble alkylated phenothiazine, and an oil soluble sulfurized compound, said sulfurized compound selected from the group consisting of sulfurized olefins and sulfurized fatty oils.

2. The lubricating composition according to claim 1 wherein said lubricating oil is selected from the group consisting of paraffinic oils, naphthenic oils, aromatic oils, and synthetic oils and mixtures thereof.

3. The lubricating composition according to claim 1 wherein the alkylated diarylamine has a concentration of about 0.05 to 2.5 wt % in the lubricating composition.

4. The lubricating composition according to claim 1 wherein the alkylated diarylamine is selected from the group consisting of: alkylated diphenylamine, alkylated 3-hydroxydiphenylamine, N-phenyl-1,2-phenylenediamine, N-phenyl-1,4-phenylenediamine, monobutyldiphenylamine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyldiphenylamine, p-oriented styrenated diphenylamine, mixed butyloctyldiphenylamine, and mixed octylstryryldiphenylamine.

5. The lubricating composition according to claim 1 wherein said alkylated phenothiazine has a concentration of about 0.05 to 2.5 wt % in the lubricating composition.

6. The lubricating composition according to claim 1 wherein said alkylated phenothiazine has the chemical formula:

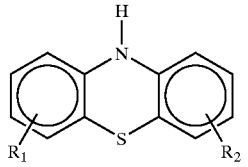

wherein R1 is a linear or branched C4–C24 alkyl, aryl, heteroalkyl or alkylaryl group and R2 is hydrogen or a linear or branched C4–C24 alkyl, aryl, heteroalkyl, or alkylaryl group.

7. The lubricating composition according to claim 1 wherein said alkylated phenothiazine is selected from the group consisting of monotetradecylphenothiazine, ditetradecylphenothiazine, monodecylphenothiazine, didecylphenothiazine, monononylphenothiazine, dinonylphenothiazine, monoctylphenothiazine dioctylphenothiazine, monobutylphenothiazine, dibutylphenothiazine, monostyrylphenothiazine, distyrylphenothiazine, butyloctylphenothiazine, and styryloctylphenothiazine.

8. The lubricating composition according to claim 1 wherein said sulfurized compound has a concentration sufficient to provide from about 150 to 2500 ppm of sulfur in the lubricating composition.

9. The lubricating composition according to claim 1 wherein said sulfurized olefin is selected from the group consisting of sulfurized alpha-olefins, sulfurized isomerized alpha-olefins, sulfurized branched olefins, sulfurized cyclic olefins, and combinations thereof.

10. The lubricating composition according to claim 1 wherein said sulfurized fatty oil is selected from the group consisting of sulfurized corn oil, sulfurized canola oil, sulfurized cottonseed oil, sulfurized grapeseed oil, sulfurized olive oil, sulfurized palm oil, sulfurized peanut oil, sulfurized coconut oil, sulfurized rapeseed oil, sulfurized sesame seed oil, sulfurized soybean oil, sulfurized sunflower seed oil, sulfurized tallow, sulfurized fish oil and combinations thereof.

11. The lubricating composition according to claim 1 additionally comprising an ashless dialkyldithiocarbamate.

12. The lubricating composition according to claim 11 wherein said ashless dialkyldithiocarbamate has a concentration sufficient to provide from about 150 to 2500 ppm of sulfur in the lubricating composition.

13. The lubricating composition according to claim 11 wherein said ashless dialkyldithiocarbanate is selected from the group consisting of: methylenebis (dialkyldithiocarbamate), ethylenebis (dialkyldithiocarbamate), isobutyl disulfide-2,2'-bis (dialkyldithiocarbamate), dibutyl-N,N-dibutyl-(dithiocarbamyl)succinate, 2-hydroxypropyl dibutyldithiocarbamate, butyl(dibutyldithiocarbamyl) acetate, S-carbomethoxy-ethyl-N,N-dibutyl dithiocarbamate, hydroxyalkyl substituted dialkyldithiocarbamates, dithiocarbamates prepared from unsaturated compounds, dithiocarbamates prepared from norbornylene, and dithocarbamates prepared from epoxides.

14. The lubricating composition according to claim 1 additionally comprising at least one additional component selected from the group consisting of: dispersants, detergents, anti-wear additives, antioxidants, friction modifiers, anti-foaming additives, pour point depressants, and viscosity index improvers.

15. The lubricating composition according to claim 1, wherein the lubricating composition contains 250 to 900 ppm phosphorus.

16. The lubricating composition according to claim 1, wherein the lubricating composition contains zero to 250 ppm phosphorus.

17. A lubricating composition comprising a major amount of lubricating oil, and a minor amount of an oil soluble alkylated diarylamine, an oil soluble alkylated phenothiazine, and an oil soluble ashless dialkyldithiocarbamate.

18. The lubricating composition according to claim 17 wherein said lubricating oil is selected from the group consisting of paraffinic oils, naphthenic oils, aromatic oils, and synthetic oils and mixtures thereof.

19. The lubricating composition according to claim 17 wherein the alkylated diarylamine has a concentration of about 0.05 to 2.5 wt % in the lubricating composition.

20. The lubricating composition according to claim 17 wherein the alkylated diarylamine is selected from the group consisting of: alkylated diphenylamine, alkylated 3-hydroxydiphenylamine, N-phenyl-1,2-phenylenediamine, N-phenyl-1,4-phenylenediamine, monobutyldiphenyl amine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyldiphenylamine, p-oriented styrenated diphenylamine, mixed butyloctyldiphenylamine, and mixed octylstryryldiphenylamine.

21. The lubricating composition according to claim 17 wherein said alkylated phenothiazine has a concentration of about 0.05 to 2.5 wt % in the lubricating composition.

22. The lubricating composition according to claim 17 wherein said alkylated phenothiazine has the chemical formula:

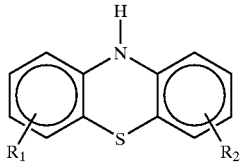

wherein R1 is a linear or branched C4–C24 alkyl, aryl, heteroalkyl or alkylaryl group and R2 is hydrogen or a linear or branched C4–C24 alkyl, aryl, heteroalkyl, or alkylaryl group.

23. The lubricating composition according to claim 17 wherein said alkylated phenothiazine is selected from the group consisting of monotetradecylphenothiazine, ditetradecylphenothiazine, monodecylphenothiazine, didecylphenothiazine, monononylphenothiazine, dinonylphenothiazine, monooctylphenothiazine, dioctylphenothiazine monobutylphenothiazine, dibutylphenothiazine, monostyrylphenothiazine, distyrylphenothiazine, butyloctylphenothiazine, and styryloctylphenothiazine.

24. The lubricating composition according to claim 17 wherein said ashless dialkyldithiocarbamate has a concentration sufficient to provide from about 150 to 2500 ppm of sulfur in the lubricating composition.

25. The lubricating composition according to claim 17 wherein said ashless dialkyldithiocarbamate is selected from the group consisting of: methylenebis (dialkyldithiocarbamate), ethylenebis (dialkyldithiocarbamate), isobutyl disulfide-2,2'-bis (dialkyldithiocarbamate), dibutyl-N,N-dibutyl-(dithiocarbamyl)succinate, 2-hydroxypropyl dibutyldithiocarbamate, butyl(dibutyldithiocarbamyl) acetate, S-carbomethoxy-ethyl-N,N-dibutyl dithiocarbamate, hydroxyalkyl substituted dialkyldithiocarbamates, dithiocarbamates prepared from unsaturated compounds, dithiocarbamates prepared from norbornylene, and dithiocarbamates prepared from epoxides.

26. The lubricating composition according to claim 17 additionally comprising at least one sulfurized compound, said sulfurized compound selected from the group consisting of sulfurized olefins and sulfurized fatty oils.

27. The lubricating composition according to claim 17 additionally comprising at least one additional component selected from the group consisting of: dispersants, detergents, anti-wear additives, antioxidants, friction modifiers, anti-foaming additives, pour point depressants, and viscosity index improvers.

28. The lubricating composition according to claim 17, wherein the lubricating composition contains 250 to 900 ppm phosphorus.

29. The lubricating composition according to claim 17, wherein the lubricating composition contains zero to 250 ppm phosphorus.

30. A lubricating additive comprising an oil soluble alkylated diarylamine, an oil soluble alkylated phenothiazine, and an oil soluble sulfurized compound, said sulfurized compound selected from the group consisting of sulfurized olefins and sulfurized fatty oils, wherein said lubricating additive forms a lubricating composition when added to a lubricating oil.

31. The lubricating additive according to claim 30 wherein the alkylated diarylamine has a concentration sufficient to constitute about 0.05 to 2.5 wt % in the lubricating composition.

32. The lubricating additive according to claim 30 wherein the alkylated diarylamine is selected from the group consisting of: alkylated diphenylamine, alkylated 3-hydroxydiphenylamine, N-phenyl-1,2-phenylenediamine, N-phenyl-1,4-phenylenediamine, monobutyldiphenylamine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyldiphenylamine, p-oriented styrenated diphenylamine, mixed butyloctyldiphenylamine, and mixed octylstryryldiphenylamine.

33. The lubricating additive according to claim 30 wherein said alkylated phenothiazine has a concentration sufficient to constitute about 0.05 to 2.5 wt % in the lubricating composition.

34. The lubricating additive according to claim 30 wherein said alkylated phenothiazine has the chemical formula:

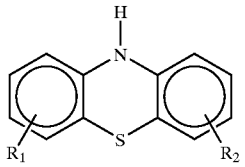

wherein R1 is a linear or branched C4–C24 alkyl, aryl, heteroalkyl or alkylaryl group and R2 is hydrogen or a linear or branched C4–C24 alkyl, aryl, heteroalkyl, or alkylaryl group.

35. The lubricating additive according to claim 30 wherein said alkylated phenothiazine is selected from the group consisting of monotetradecylphenothiazine, ditetradecylphenothiazine, monodecylphenothiazine, didecylphenothiazine, monononylphenothiazine, dinonylphenothiazine, monoctylphenothiazine and dioctylphenothiazine, monobutylphenothiazine, dibutylphenothiazine, monostyrylphenothiazine, distyrylphenothiazine, butyloctylphenothiazine, and styryloctylphenothiazine.

36. The lubricating additive according to claim 30 wherein said sulfurized compound has a concentration sufficient to provide from about 150 to 2500 ppm of sulfur in the lubricating composition.

37. The lubricating additive according to claim 30 wherein said sulfurized olefin is selected from the group consisting of sulfurized alpha-olefins, sulfurized isomerized alpha-olefins, sulfurized branched olefins, sulfurized cyclic olefins, and combinations thereof.

38. The lubricating additive according to claim 30 wherein said sulfurized fatty oil is selected from the group consisting of sulfurized corn oil, sulfurized canola oil, sulfurized cottonseed oil, sulfurized grapeseed oil, sulfurized olive oil, sulfurized palm oil, sulfurized peanut oil, sulfurized coconut oil, sulfurized rapeseed oil, sulfurized sesame seed oil, sulfurized soybean oil, sulfurized sunflower seed oil, sulfurized tallow, sunfurized fish oil, and combinations thereof.

39. The lubricating additive according to claim 30 additionally comprising an ashless dialkyldithiocarbamate.

40. The lubricating additive according to claim 39 wherein said ashless dialkyldithiocarbamate has a concentration sufficient to provide from about 150 to 2500 ppm of sulfur in the lubricating composition.

41. The lubricating additive according to claim 39 wherein said ashless dialkyldithiocarbamate is selected from the group consisting of: methylenebis (dialkyldithiocarbamate), ethylenebis (dialkyldithiocarbamate), isobutyl disulfide-2,2'-bis (dialkyldithiocarbamate), dibutyl-N,N-dibutyl-(dithiocarbamyl)succinate, 2-hydroxypropyl dibutyldithiocarbamate, butyl(dibutyldithiocarbamyl) acetate, S-carbomethoxy-ethyl-N,N-dibutyl dithiocarbamate, hydroxyalkyl substituted dialkyldithiocarbamates, dithiocarbamates prepared from unsaturated compounds, dithiocarbamates prepared from norbornylene, and dithiocarbamates prepared from epoxides.

42. The lubricating additive according to claim 30 additionally comprising at least one additional component selected from the group consisting of: dispersants, detergents, anti-wear additives, antioxidants, friction modifiers, anti-foaming additives, pour point depressants, and viscosity index improvers.

43. The lubricating additive according to claim 30, wherein the lubricating composition contains 250 to 900 ppm phosphorus.

44. The lubricating composition according to claim 30, wherein the lubricating composition contains zero to 250 ppm phosphorus.

45. A lubricating additive comprising an oil soluble alkylated diarylamine, an oil soluble alkylated phenothiazine, and an oil soluble ashless dialkyldithiocarbamate, wherein said lubricating additive forms a lubricating composition when added to a lubricating oil.

46. The lubricating additive according to claim 45 wherein the alkylated diarylamine has a concentration sufficient to constitute about 0.05 to 2.5 wt % in the lubricating composition.

47. The lubricating additive according to claim 45 wherein the alkylated diarylamine is selected from the group consisting of: alkylated diphenylamine, alkylated 3-hydroxydiphenylamine, N-phenyl-1,2-phenylenediamine, N-phenyl-1,4-phenylenediamine, monobutyldiphenylamine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyldiphenylamine, p-oriented styrenated diphenylamine, mixed butyloctyldiphenylamine, and mixed octylstryryldiphenylamine.

48. The lubricating additive according to claim 45 wherein said alkylated phenothiazine has a concentration sufficient to constitute about 0.05 to 2.5 wt % in the lubricating composition.

49. The lubricating additive according to claim 45 wherein said alkylated phenothiazine has the chemical formula:

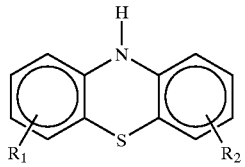

wherein R1 is a linear or branched C4–C24 alkyl, aryl, heteroalkyl or alkylaryl group and R2 is hydrogen or a linear or branched C4–C24 alkyl, aryl, heteroalkyl, or alkylaryl group.

50. The lubricating additive according to claim 45 wherein said alkylated phenothiazine is selected from the group consisting of monotetradecylphenothiazine, ditetradecylphenothiazine, monodecylphenothiazine, didecylphenothiazine, monononylphenothiazine, dinonylphenothiazine, monooctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

51. The lubricating additive according to claim 45 wherein said ashless dialkyldithiocarbamate has a concentration sufficient to provide from about 150 to 2500 ppm of sulfur in the lubricating composition.

52. The lubricating additive according to claim 45 wherein said ashless dialkyldithiocarbamate is selected from the group consisting of: methylenebis (dialkyldithiocarbamate), ethylenebis (dialkyldithiocarbamate), isobutyl disulfide-2,2'-bis (dialkyldithiocarbamate), dibutyl-N,N-dibutyl-(dithiocarbamyl)succinate, 2-hydroxypropyl dibutyldithiocarbamate, butyl(dibutyldithiocarbamyl) acetate, S-carbomethoxy-ethyl-N,N-dibutyl dithiocarbamate, hydroxyalkyl substituted dialkyldithiocarbamates, dithiocarbamates prepared from unsaturated compounds, dithiocarbamates prepared from norbornylene, and dithiocarbamates prepared from epoxides.

53. The lubricating additive according to claim 45 additionally comprising at least one sulfurized compound, said sulfurized compound selected from the group consisting of sulfurized olefins and sulfurized fatty oils.

54. The lubricating additive according to claim 45 additionally comprising at least one additional component selected from the group consisting of: dispersants, detergents, anti-wear additives, antioxidants, friction modifiers, anti-foaming additives, pour point depressants, and viscosity index improvers.

55. The lubricating additive according to claim 45, wherein the lubricating composition contains 250 to 900 ppm phosphorus.

56. The lubricating additive according to claim 45, wherein the lubricating composition contains zero to 250 ppm phosphorus.

57. A method for improving the antioxidancy and/or deposit formation properties of a lubricating composition comprising the step of including in the lubricating composition an oil soluble alkylated diarylamine, an oil soluble alkylated phenothiazine, and an oil soluble sulfurized compound, said sulfurized compound selected from the group consisting of sulfurized olefins and sulfurized fatty oils.

58. The method according to claim 57 wherein the alkylated diarylamine has a concentration of about 0.05 to 2.5 wt % in the lubricating composition.

59. The method according to claim 57 wherein the alkylated diarylamine is selected from the group consisting of: alkylated diphenylamine, alkylated 3-hydroxydiphenylamine, N-phenyl-1,2-phenylenediamine, N-phenyl-1,4-phenylenediamine, monobutyldiphenylamine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyldiphenylamine, p-oriented styrenated diphenylamine, mixed butyloctydiphenylamine, and mixed octylstryryldiphenylamine.

60. The method according to claim 57 wherein said alkylated phenothiazine has a concentration of about 0.05 to 2.5 wt % in the lubricating composition.

61. The method according to claim 57 wherein said alkylated phenothiazine has the chemical formula:

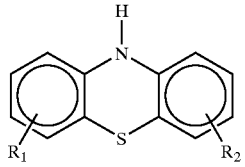

wherein R1 is a linear or branched C4–C24 alkyl, aryl, heteroalkyl or alkylaryl group and R2 is hydrogen or a linear or branched C4–C24 alkyl, aryl, heteroalkyl, or alkylaryl group.

62. The method according to claim 57 wherein said alkylated phenothiazine is selected from the group consisting of monotetradecylphenothiazine, ditetradecylphenothiazine, monodecylphenothiazine, didecylphenothiazine, monononylphenothiazine, dinonylphenothiazine, monoctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

63. The method according to claim 57 wherein said sulfurized compound has a concentration sufficient to provide from about 150 to 2500 ppm of sulfur in the lubricating composition.

64. The method according to claim 57 wherein said sulfurized olefin is selected from the group consisting of sulfurized alpha-olefins, sulfurized isomerized alpha-olefins, sulfurized branched olefins, sulfurized cyclic olefins, and combinations thereof.

65. The method according to claim 57 wherein said sulfurized fatty oil is selected from the group consisting of sulfurized corn oil, sulfurized canola oil, sulfurized cottonseed oil, sulfurized grapeseed oil, sulfurized olive oil, sulfurized palm oil, sulfurized peanut oil, sulfurized coconut oil, sulfurized rapeseed oil, sulfurized sesame seed oil, sulfurized soybean oil, sulfurized sunflower seed oil, sulfurized tallow, sulfurized fish oil, and combinations thereof.

66. The method according to claim 57 additionally comprising the step of including an ashless dialkyldithiocarbamate in the lubricating composition.

67. The method according to claim 66 wherein said ashless dialkyldithiocarbamate has a concentration sufficient to provide from about 150 to 2500 ppm of sulfur in the lubricating composition.

68. The method according to claim 66 wherein said ashless dialkyidithiocarbamate is selected from the group consisting of: methylenebis(dialkyldithiocarbamate), ethylenebis(dialkyldithiocarbamate), isobutyl disulfide-2,2'-bis(dialkyldithiocarbamate), dibutyl-N,N-dibutyl-(dithiocarbamyl)succinate, 2-hydroxypropyl dibutyldithiocarbamate, butyl(dibutyldithiocarbamyl) acetate, S-carbomethoxy-ethyl-N,N-dibutyl dithiocarbamate, hydroxyalkyl substituted dialkyldithiocarbamates, dithiocarbamates prepared from unsaturated compounds, dithiocarbamates prepared from norbornylene, and dithiocarbamates prepared from epoxides.

69. The method according to claim 57 additionally comprising the step of including at least one additional component in the lubricating composition, said at least one additional component selected from the group consisting of: dispersants, detergents, anti-wear additives, antioxidants, friction modifiers, anti-foaming additives, pour point depressants, and viscosity index improvers.

70. A method for improving the antioxidancy and/or deposit formation properties of a lubricating composition comprising the step of including in the lubricating composition an oil soluble alkylated diarylamine, an oil soluble alkylated phenothiazine, and an oil soluble ashless dialkyldithiocarbamate.

71. The method according to claim 70 wherein the alkylated diarylamine has a concentration of about 0.05 to 2.5 wt % in the lubricating composition.

72. The method according to claim 70 wherein the alkylated diarylamine is selected from the group consisting of: alkylated diphenylamine, alkylated 3-hydroxydiphenylamine, N-phenyl-1,2-phenylenediamine, N-phenyl-1,4-phenylenediamine, monobutyldiphenylamine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyldiphenylamine, p-oriented styrenated diphenylamine, mixed butyloctyldiphenylamine, and mixed octylstryryldiphenylamine.

73. The method according to claim 70 wherein said alkylated phenothiazine has a concentration of about 0.05 to 2.5 wt % in the lubricating composition.

74. The method according to claim 70 wherein said alkylated phenothiazine has the chemical formula:

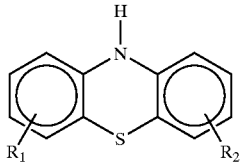

wherein R1 is a linear or branched C4–C24 alkyl, heteroalkyl or alkylaryl group and R2 is hydrogen or a linear or branched alkyl, heteroalkyl, or alkylaryl group.

75. The method according to claim 70 wherein said alkylated phenothiazine is selected from the group consisting of monotetradecylphenothiazine, ditetradecylphenothiazine, monodecylphenothiazine, didecylphenothiazine, monononylphenothiazine, dinonylphenothiazine, monoctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

76. The method according to claim 70 wherein said ashless dialkyldithiocarbamate has a concentration sufficient to provide from about 150 to 2500 ppm of sulfur in the lubricating composition.

77. The method according to claim 70 wherein said ashless dialkyldithiocarbamate is selected from the group consisting of: methylenebis(dialkyldithiocarbamate), ethylenebis(dialkyldithiocarbamate), isobutyl disulfide-2,2'-bis(dialkyldithiocarbamate), dibutyl-N,N-dibutyl-(dithiocarbamyl)succinate, 2-hydroxypropyl dibutyldithiocarbamate, butyl(dibutyidithiocarbamyl) acetate, S-carbomethoxy-ethyl-N,N-dibutyl dithiocarbamate, hydroxyalkyl substituted dialkyldithiocarbamates, dithiocarbamates prepared from unsaturated compounds, dithiocarbamates prepared from norbornylene, and dithiocarbamates prepared from epoxides.

78. The method according to claim 70 additionally comprising the step of including at least one sulfurized compound in said lubricating composition, said sulfurized compound selected from the group consisting of sulfurized olefins and sulfurized fatty oils.

79. The method according to claim 70 additionally comprising the step of including at least one additional component in said lubricating composition, said at least one additional component selected from the group consisting of: dispersants, detergents, anti-wear additives, antioxidants, friction modifiers, anti-foaming additives, pour point depressants, and viscosity index improvers.

80. A method for lubricating an engine comprising lubricating said engine with the lubricating composition of claim 1.

* * * * *